United States Patent [19]

Noguera

[11] 3,943,690

[45] Mar. 16, 1976

[54] YARN SPINNING APPARATUS

[76] Inventor: John Michael Noguera, 1 Greville House, Kinnerton St., London, S.W. 1, England

[22] Filed: Sept. 20, 1974

[21] Appl. No.: 567,984

[30] Foreign Application Priority Data

Sept. 21, 1973 United Kingdom ..... 44501/73
Mar. 1, 1974 United Kingdom ..... 9479/74

[52] U.S. Cl. ..... 57/58.89; 57/58.95
[51] Int. Cl.[2] ..... D01H 1/12
[58] Field of Search ..... 57/58.89–58.95, 56

[56] References Cited

UNITED STATES PATENTS

| | | | |
|---|---|---|---|
| 3,360,917 | 1/1968 | Kubovy et al. | 57/58.95 |
| 3,455,097 | 7/1969 | Rajnoha et al. | 57/58.95 |
| 3,624,994 | 12/1971 | Rohlena et al. | 57/58.91 |
| 3,624,997 | 12/1971 | Didek et al. | 57/58.91 |
| 3,626,681 | 12/1971 | Naruse | 57/58.91 |
| 3,763,641 | 10/1973 | Doublebsky et al. | 57/56 |
| 3,834,145 | 9/1974 | Ellingham et al. | 57/56 |
| 3,837,154 | 9/1974 | Stahlecker | 57/58.89 |

*Primary Examiner*—John Petrakes
*Attorney, Agent, or Firm*—Haseltine, Lake & Waters

[57] ABSTRACT

An open end yarn spinning apparatus having a hollow opening roller for feeding fibres to a collecting surface formed in a rotor, the curved wall of the roller being such as to permit gaseous flow from inside the roller to outside the roller, and a rotatable impeller arranged to produce a positive gas pressure within the hollow roller during operation of the apparatus to cause a gaseous flow to pass from inside the roller to outside the roller, said impeller being mounted so as to be constrained to rotate with another member of the apparatus that rotates in operation of the apparatus.

7 Claims, 5 Drawing Figures

YARN SPINNING APPARATUS

Figure 1:
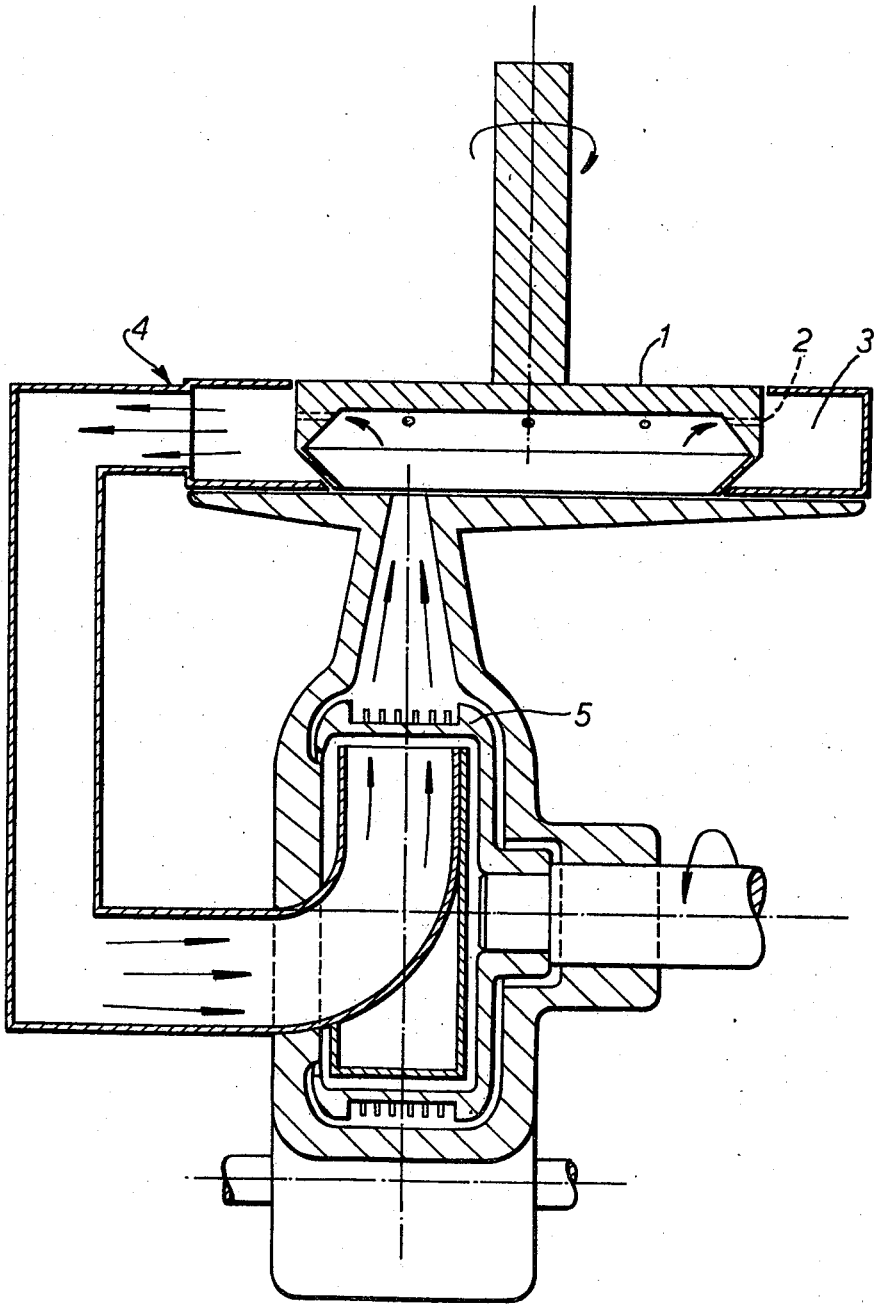

This invention relates to apparatus for spinning yarn by the open end spinning process, that is the process in which a twisted yarn is formed by continuously depositing discrete fibres on to the rotating end of a yarn. In one of the most common methods of open end spinning, fibres are deposited on to a rotating collecting surface around which the loose end of a yarn is made to pass. As the yarn is withdrawn from the collecting surface it takes with it the fibres which have been deposited thereon and the rotation of the collecting surface imparts the necessary twists to form the yarn. The collecting surface can be the inner surface of a rotor, the yarn being continuously withdrawn from the top or bottom of the rotor by the tail end of the yarn.

Commonly used for depositing the fibres on to the collecting surface is an opening roller that rotates, in operation of the apparatus, at a fairly high speed of the order of 5,000 r.p.m. In operation a spiked surface of this opening roller acts on a sliver (a thick strand of textile fibre) fed thereto to separate out individual fibres and eject them at high speed towards the collecting surface.

One of the problems that has been found in practice when using opening rollers is that different types of fibre react differently to the spiked surface on the roller. For example, for a type of surface of the opening roller which works well with cotton fibres, it is found that some man-made fibres, for example polyesters, cling to the surface so much that after spinning for a few minutes the whole roller becomes completely overloaded with fibres and comes to a standstill.

In the past attempts have been made to overcome this problem by making the opening rollers themselves replaceable so that rollers with different types of surface can be used for different types of fibres. It has also been proposed to overcome this problem by providing a hollow opening roller the curved wall of which is perforated or porous so that when the fibres are sucked off the surface of the roller, air passes through the curved wall of the roller and helps to remove the fibres. In practice it has been found, however, that it is difficult to generate sufficient suction for such a system to work well, and it has further been proposed to incorporate in spinning apparatus ancillary equipment for producing a positive pressure within the hollow opening roller but the provision of such equipment leads to increased cost and a more complicated apparatus.

The object of the present invention is to produce a yarn spinning apparatus incorporating a hollow opening roller with a curved wall that is perforated or porous and which overcomes the aforesaid disadvantages.

According to the present invention there is provided an open end yarn spinning apparatus having a hollow opening roller for feeding fibres to a collecting surface formed in a rotor, the curved wall of the roller being such as to permit gaseous flow from inside the roller to outside the roller, and a rotatable impeller arranged to produce a positive gas pressure within the hollow roller during operation of the apparatus to cause a gaseous flow to pass from inside the roller to outside the roller; said impeller being mounted so as to be constrained to rotate with another member of the apparatus that rotates in operation of the apparatus.

Figure 2:
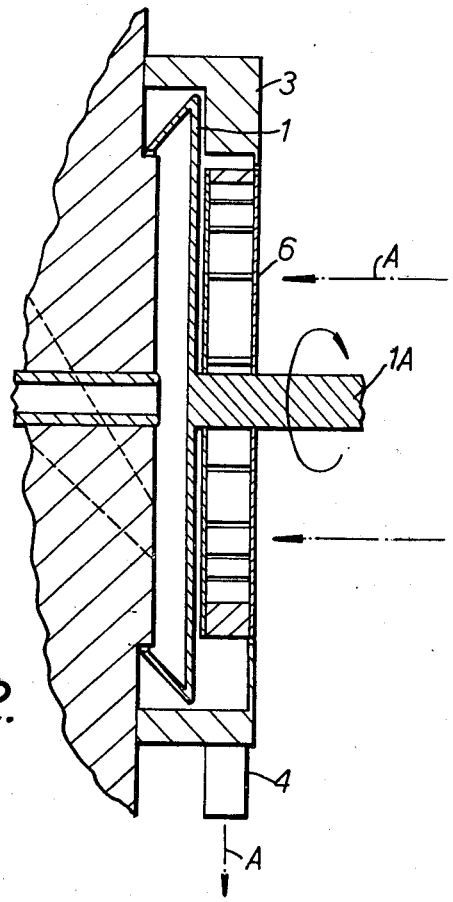
Figure 5:
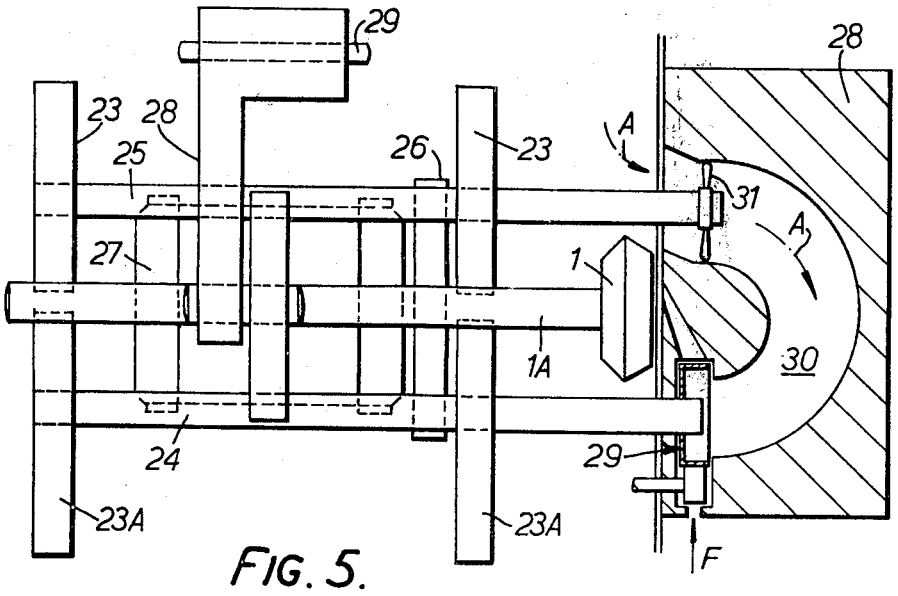
Figure 3:
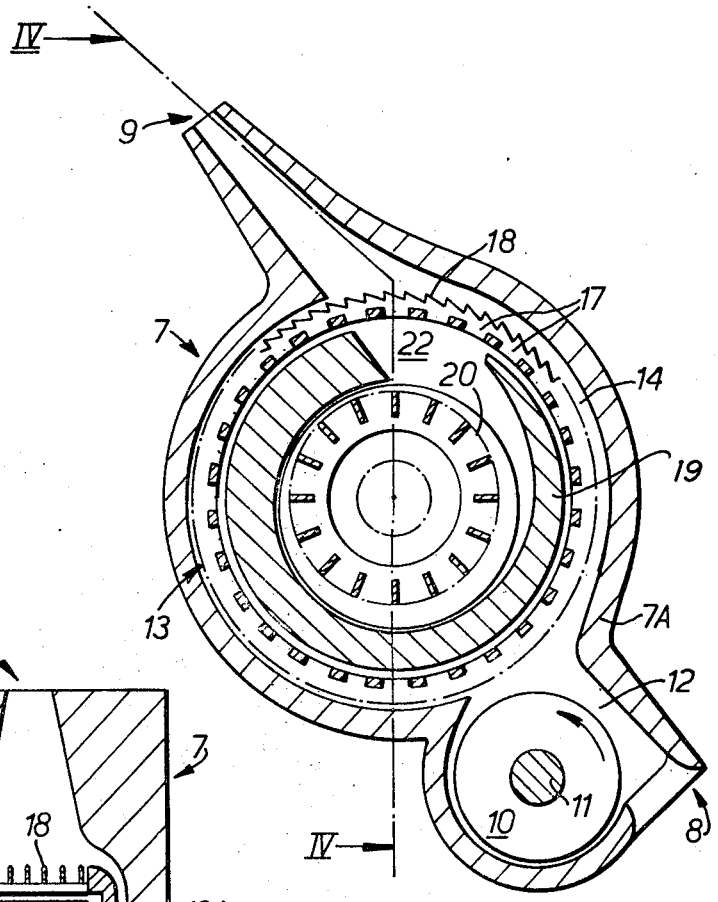
Figure 4:
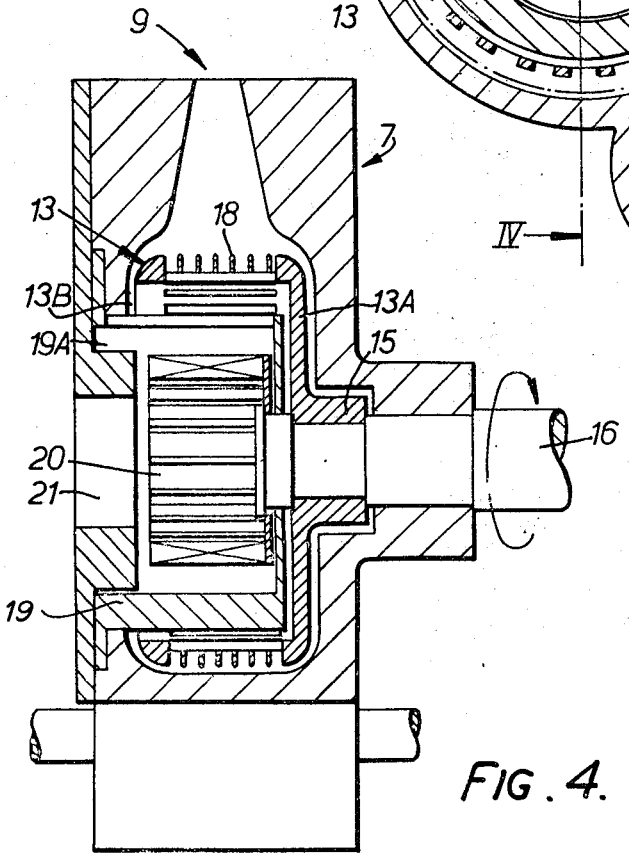

For a better understanding of the invention and to show how the same can be carried into effect, reference will now be made, by way of example only, to the accompanying drawings, in which:

FIG. 1 is a sectional side view of a first form of open end yarn spinning apparatus, FIG. 2 is a sectional side view of part of a second form of open end yarn spinning apparatus, FIG. 3 is a sectional side view of an opening device of a second form of open end yarn spinning apparatus, FIG. 4 is a section taken on the line IV—IV in FIG. 3, and FIG. 5 is a schematic plan view of a further form of open end yarn spinning apparatus.

In the apparatus of FIG. 1, a rotor 1 having a collecting surface for fibres to be twisted into yarn has venting holes 2 around its outer surface, these holes being arranged in such a way that when the rotor is spinning an under pressure is formed in the inside of the rotor and air is expelled to the outside of the rotor. The rotor is enclosed in a housing 3 from which there is a duct 4 which passes to the inside of a hollow opening roller 5. The curved wall of the roller 5 is perforated so that air supplied through the duct 4 can pass from inside the roller 5 to outside the roller 5. To this end the curved wall of the roller 5 can have parallel slots formed therethrough extending in the direction of the axis of rotation of the roller, or can have perforations of form other than slot-like, or the curved wall can be formed of porous material.

In operation, and as illustrated by arrows in the Figure, air that is expelled by the rotor 1, which is thus acting as a rotatable impeller, is trapped within the housing 3 around the rotor 1 and conducted to the interior of the opening roller 5 where a positive air pressure is produced so that air blows through the roller 5 to reinforce the suction feed for the fibres that is created by the spinning rotor.

It is to be noted that in the arrangement shown in FIG. 1 the axes of the rotor 1 and roller 5 are at right angles to each other. However, this need not necessarily be the case and these axes could be other than at right angles, for example (and in particular) they could be parallel.

In the alternative form of FIG. 2, venting holes in the rotor are omitted and instead a fan 6 mounted on the shaft 1A of the rotor 1 to rotate with the rotor 1 serves as an impeller that passes air through the duct 4 to the opening roller to blow through the roller as just described. The air flow is indicated by arrows A in FIG. 2.

Turning next to FIGS. 3 and 4, the opening device shown in these Figures has a housing 7 having an inlet 8 and an outlet 9. Within the housing 7, adjacent the inlet 8, there is an intake roller 10 mounted on a driven shaft 11. The outer curved surface of the roller 10 co-operates with a wall 7A of the housing 7 to form a nip 12.

Between the roller 10 and the outlet 9 there is a hollow opening roller 13 that also co-operates with the housing wall 7A to form a nip 14. The roller 13 is of greater diameter than the roller 10 (twice as large in the particular form shown). A boss 15 projecting from one side wall 13A of the roller 13 is fast with a driven shaft 16. At the other side 13B the roller 13 is open.

The curved wall of the roller 13 is perforated so that air can pass from inside the roller 13 to outside the roller 13. To this end the curved wall of the roller 13 has parallel slots 17 formed therethrough extending in the direction of the axis of rotation of the roller 13. Alternatively, the curved wall can have perforations of form other than slot-like, or the curved wall can be formed of porous material.

Secured around the outside of the curved wall of the roller 13 there are spaced apart strips 18 of saw tooth form.

Within the roller 13 there is an air impeller unit 20 having a housing 19 which is supported by the main housing 7 so as to be stationary with respect to the roller 13, which it enters through the open side 13B. The impeller unit housing 19 contains an impeller fan 20 which is mounted on the driven shaft 16 so as to be co-axial with the roller 13, and so as to rotate with the roller 13. An open side 19A of the impeller unit housing 19 co-operates with an opening 21 in the housing 7 so that an air inlet path to the fan 20 is provided.

In operation the rollers 10 and 13 are both rotated anti-clockwise as viewed in FIG. 1, the roller 10 at very low speed of the order of 10 r.p.m. and the roller 13 at fairly high speed of the order of 5,000 to 10,000 r.p.m. A sliver is fed into the intake 8 to be drawn by the roller 10 through the nip 12 and fed to the nip 14. The saw tooth strips 18 carried by the roller 13 act on the sliver to separate out individual fibres and eject these at high speed through the outlet 9. As the fan 20 rotates with the roller 13, there is set up at the same time an air flow from the opening 21 that exits from the impeller unit housing 19 through an opening 22 in line with the main housing outlet 9; and that then passes from the inside of the roller 13 to the outside of the roller 13, acting, as it does, to blow fibres that may be caught on the saw tooth strips 18 off these strips and through the outlet 9. By thus minimising the risk of fibres adhering to the strips 18 and being carried around by the roller 13, possibly for several revolutions before becoming detached, the obtaining of a regular flow of fibres through the outlet 9 is facilitated.

It is to be noted that the impeller unit 19 can be designed to provide an air current that is so substantial that it is not necessary to provide any other equipment, such as evacuation equipment, for increasing the air flow through the rotor 13.

Finally FIG. 5 shows the rotor 1 of the apparatus of this Figure having its shaft 1A supported on two pairs of rollers 23 and 23A, the rollers 23A being mounted on a first common shaft 24 and the rollers 23 being mounted on a second common shaft 25. The shaft 25 is drivingly engaged with a drive wheel 26 driven by an electric motor 27, the shaft 24 not being in contact with this drive wheel so that the shaft 25 serves to drive the shaft 24 via the shaft 1A. The wheel 26 is of large diameter relative to the diameter of the shaft 25 such that with the motor running to drive the wheel 26 at the order of 3,000 r.p.m., the shaft 25 is rotated at the order of 15,000 r.p.m. The diameter of the roller 23 relative to the shaft 1A is substantially greater and such that the rotor 1 is consequently rotated at a speed of 50,000 to 100,000 r.p.m., depending on the particular diameters selected in any particular embodiment. A spring loaded arm 28 pivoting about a pin 29 causes a further roller to bear on the shaft 1A to hold it in engagement with the pairs of rollers 23 and 23A.

In this form of apparatus there is, adjacent the rotor 1, a housing 28 containing the opening roller 29 of an opening device, fibre feed to this roller 29 being indicated by the arrow F. This roller 29 is hollow with a perforated or porous curved wall as described above, and a duct 30 within the housing 28 connects the interior of the roller 29 with an impeller in the form of a fan

31 mounted in the duct 30 on an end of the roller shaft 25. The air flow set up by this fan 31, indicated by arrows A, passes through the roller 29 as described above.

It will be appreciated that in all the forms described there is provided a rotatable impeller arranged to produce a positive gas pressure within the hollow opening roller, this impeller being mounted so as to be constrained to rotate with another member of the apparatus that rotates in operation of the apparatus. Thus a device for producing a positive pressure within the opening rollers is simply provided utilizing a minimum of additional components, and a drive for this device is obtained simply from a member already present that rotates in operation of the apparatus.

I claim:

1. An open end yarn spinning apparatus comprising in combination:

a hollow cylindrical opening roller adapted to feed fibres to a fibre collecting surface having the peripheral wall thereof formed such as to permit gaseous flow from inside the roller to outside the roller; and impeller means rotatable with the apparatus for producing a positive gas pressure within said roller during operation of the apparatus to cause a gaseous flow to pass from inside the roller to outside the roller through said peripheral wall.

2. An open end yarn spinning apparatus as claimed in claim 1, including a rotor provided with said fibre collecting surface therein and comprising said impeller means, a housing surrounding said rotor and having an opening therein that is connected to the hollow interior of said opening roller whereby air expelled from the rotor passes through the opening in the housing and is directed to the inside of the opening roller to thereby produce said positive gas pressure within the hollow roller and assist in removing fibres from the surface thereof.

3. An open end yarn spinning apparatus as claimed in claim 2, including venting holes in the said rotor around its outer surface arranged such that when the rotor is spinning an under pressure is formed in the inside of the rotor and air is expelled to the outside of the rotor.

4. An open end yarn spinning apparatus as claimed in claim 2, including a duct extending from said housing to the interior of the hollow opening roller and through which said air is expelled from the rotor is directed to the inside of the opening roller.

5. An open end yarn spinning apparatus as claimed in claim 1, including a rotor provided with said fiber collecting surface, a drive shaft for said rotor, , a fan comprising said impeller means mounted on said rotor drive shaft for rotation therewith and connected to pass air to the interior of the hollow roller.

6. An open end yarn spinning apparatus as claimed in claim 1, including an inner housing within the hollow opening roller that is adapted to be stationary during rotation of said roller, an air outlet from said inner housing opening into the interior of the hollow opening roller, and a fan comprising said impeller means mounted within said inner housing for rotation with said roller to thereby produce said positive gas pressure.

7. An open end yarn spinning apparatus as claimed in claim 1, including a rotor provided with said fibre collecting surface therein, a shaft mounting said rotor, rollers mounted on further shafts and adapted to drivably support said rotor shaft, a fan comprising said impeller means mounted on one of said further shafts for rotation therewith to thereby produce said positive gas pressure.

* * * * *

UNITED STATES PATENT OFFICE

CERTIFICATE OF CORRECTION

Patent No. 3,943,690 Dated March 16, 1976

Inventor(s) John Michael Noguera

It is certified that error appears in the above-identified patent and that said Letters Patent are hereby corrected as shown below:

On the cover sheet item (21) should read --507,984--.

Signed and Sealed this

*fifteenth* Day of *June 1976*

[SEAL]

*Attest:*

RUTH C. MASON
*Attesting Officer*

C. MARSHALL DANN
*Commissioner of Patents and Trademarks*